US006946992B2

(12) United States Patent
McCleary et al.

(10) Patent No.: US 6,946,992 B2
(45) Date of Patent: Sep. 20, 2005

(54) MULTIBEAM PHASED ARRAY ANTENNA

(75) Inventors: James C. McCleary, Irvine, CA (US); Paul C. Werntz, Long Beach, CA (US); David Kalian, Redondo Beach, CA (US); Raenaurd D. Turpin, Norwalk, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/741,638

(22) Filed: Dec. 18, 2003

(65) Prior Publication Data

US 2005/0134505 A1 Jun. 23, 2005

(51) Int. Cl.[7] ..... H01Q 3/26; H01Q 3/22
(52) U.S. Cl. ..... 342/368; 342/377
(58) Field of Search ..... 342/368, 372, 342/377

(56) References Cited

U.S. PATENT DOCUMENTS 4,314,250 A * 2/1982 Hanell et al. ..... 342/372
6,233,436 B1 * 5/2001 Dent ..... 455/114.2
6,640,110 B1 * 10/2003 Shapira et al. ..... 342/373
6,831,600 B1 * 12/2004 Cherrette et al. ..... 342/368

OTHER PUBLICATIONS

E. De Sanctis et al., A frequency allocation assignment by means of genetic algorithms: a C/I minimization technique for multi–level SCPC satellite channels, Proceedings of 4th European Conference on Satellite Communications, p. 363–369, Nov. 1997 (abstract only).*

G. Baruffa et al., Global Telecommunications Conference, vol. 1A, p. 291–295, 1999.*

L.D. Westbrook et al., Carrier frequency allocation in FDMA military SATCOMs, IEEE Military Communications Conference, vol. 1, p. 30–33, Oct. 2001.*

* cited by examiner

*Primary Examiner*—Thomas H. Tarcza
*Assistant Examiner*—F H Mull
(74) *Attorney, Agent, or Firm*—MacPherson Kwol Chen & Heid LLP; Greg J. Michelson

(57) ABSTRACT

Systems and methods provide intermodulation reduction techniques for multiple beam phased array antennas. For example, in accordance with an embodiment of the present invention, an optimization approach is employed to determine array element excitations that reduce IM interference.

25 Claims, 3 Drawing Sheets

MULTIBEAM PHASED ARRAY ANTENNA

TECHNICAL FIELD

The present invention relates generally to antennas and, more particularly, to multibeam phased array antennas.

BACKGROUND

Multiple beam (multibeam) phased array antennas are well known and may be employed in a wide variety of applications. One drawback, for example, of a conventional phased array antenna transmitting multiple beams from a common amplifier is that non-linear amplifier characteristics may exist that cause mixing among the signals of each beam port. This produces noise referred to as intermodulation (IM) noise or IM interference. The IM interference from each antenna element may combine coherently across antenna elements, resulting in IM beams that interfere with the reception of the desired beams.

There are various approaches for mitigating IM interference. For example, two approaches are to employ a separate array antenna aperture or a separate amplifier for each beam. However, these approaches result in additional implementation costs, consume additional space, and add to the weight of the overall phased array antenna (factors which may be significant, for example, for aircraft or spacecraft applications).

A third approach is to operate the common amplifier in a more linear region (i.e., an amplifier backoff technique) to reduce IM interference. However, this approach results in a reduction of amplifier efficiency and typically a reduction in power provided by the antenna (or for the same power provided, for example, additional input power must be provided and more heat dissipated). As a result, there is a need for improved multibeam phased array antenna techniques.

SUMMARY

Systems and methods are disclosed herein to provide intermodulation (IM) beam control or IM reduction techniques for multibeam phased array antennas. For example, in accordance with an embodiment of the present invention, an optimization approach is employed to determine array element excitations that reduce IM interference. The reduction of IM interference may be obtained by steering and/or defocusing the IM beam that is in the direction of a desired beam. In general, the optimization approach may obtain a set of array element excitations that maintain performance of the desired beams while reducing the interference level of the IM beam relative to one or more of the desired beams.

More specifically, in accordance with one embodiment of the present invention, a method of determining array element excitations for input data signals of an array antenna includes evaluating initial array element excitations to determine intermodulation interference generated when the input data signals are transmitted as corresponding antenna beams; determining expected performance of the antenna beams corresponding to the input data signals relative to the intermodulation interference; and modifying the initial array element excitations to generate modified array element excitations to improve the expected performance of the antenna beams relative to the intermodulation interference.

In accordance with another embodiment of the present invention, an antenna system includes beam forming modules adapted to receive input signals and control signals; amplifiers associated with the beam forming modules; array elements coupled to corresponding ones of the amplifiers; memory storing instructions; and a processor adapted to execute the instructions to calculate expected intermodulation interference and modify the control signals to reduce the intermodulation interference.

In accordance with another embodiment of the present invention, a method of optimizing array element excitations for input signals to an array antenna includes calculating one or more antenna beam parameters corresponding to the input signals; calculating one or more antenna beam parameters corresponding to intermodulation interference; calculating a difference between the antenna beam parameters corresponding to the input signals relative to the antenna beam parameters corresponding to the intermodulation interference; and modifying the array element excitations to reduce the intermodulation interference.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Embodiments of the present invention and their advantages are best understood by referring to the detailed description that follows. It should be appreciated that like reference numerals are used to identify like elements illustrated in one or more of the figures.

DETAILED DESCRIPTION

Figure 1:
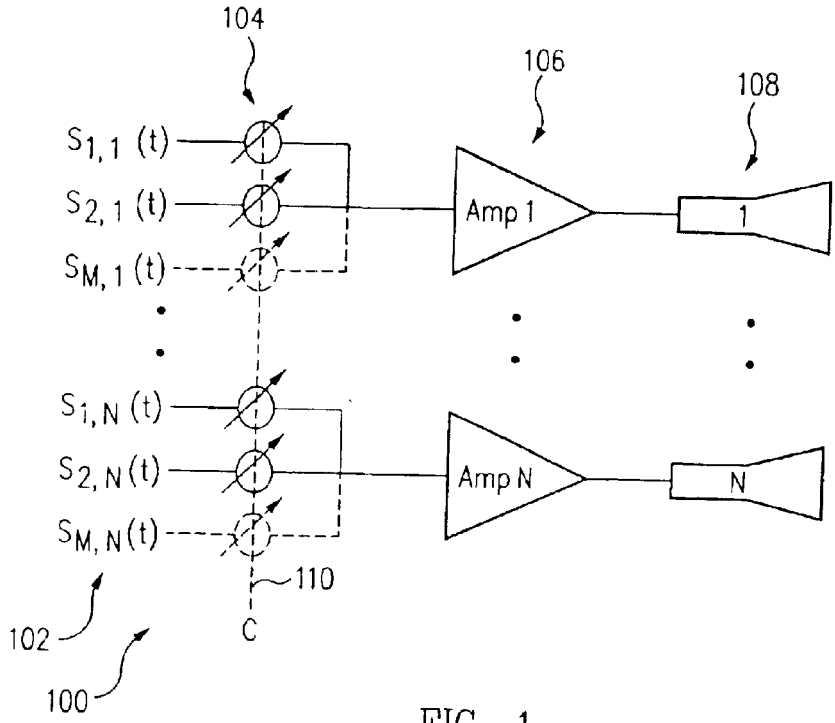
FIG. 1 shows a block diagram illustrating a multibeam array antenna in accordance with an embodiment of the present invention.

FIG. 1 shows a general block diagram illustrating an array antenna 100 in accordance with an embodiment of the present invention. Array antenna 100 includes beam forming modules 104, amplifiers 106, and array elements 108.

Input data signals 102 (i.e., the data signals to be transmitted through array elements 108) are received by beam forming modules 104 that map input data signals 102 to corresponding amplifiers 106, which provide amplified output signals to corresponding array elements 108. Input data signals 102 may include or represent any type of signal and signal modulation scheme (e.g., amplitude, frequency, and/or phase) desired, depending upon the application or requirements.

Control signals 110 are also provided to beam forming modules 104 to control phase and/or amplitude adjustments applied by beam forming modules 104 to input data signals 102. Control signals 110 provide array element excitations (e.g., amplitude and/or phase settings) to beam forming modules 104 to produce the desired antenna beams corresponding to input data signals 102 from array antenna 100. The number of array element excitations provided by control signals 110, as an example, may be equal to the number of antenna beams desired times the number of array elements 108 (i.e., equal to the number of beam forming modules 104).

Beam forming modules 104 allow a separate amplitude and/or phase excitation for each array element 108 for each antenna beam (and corresponding input data signal 102) transmitted by array antenna 100. The array aperture of array elements 108 may be any desired shape, such as for example rectangular, circular, or conformal, depending upon the desired application or design requirements.

As illustrated in FIG. 1 in an exemplary fashion, input data signals 102 (i.e., input beam signals $S_1(t)$ through $S_M(t)$) may represent "M" desired beam signals to be transmitted by array antenna 100 through "N" of array elements 108, where M and N represent any desired number of beam signals and array elements, respectively (e.g., depending upon the application or design requirements).

As an example, beam forming modules 104 (e.g., phase shifters) may form "N" groups (each group having "M" of beam forming modules 104), where the first group of beam forming modules 104 receives input data signals 102 (labeled $S_{1,1}(t)$ through $S_{M,1}(t)$) and the last group (i.e., Nth group) of beam forming modules 104 receives input data signals 102 (labeled $S_{1,N}(t)$ through $S_{M,N}(t)$). The N groups of beam forming modules 104 provide their output signals to corresponding array elements 108 (labeled 1 through N) via corresponding amplifiers 106 (labeled Amp 1 through Amp N) and may be viewed as forming N array element chains (e.g., N paths or chains through associated groups of beam forming modules 104, amplifiers 106, and array elements 108).

Amplifiers 106 (e.g., solid state power amplifiers or traveling wave tube amplifiers) represent common radio frequency (RF) amplifiers for associated input data signals 102 directed to corresponding array elements 108 (i.e., input data signals 102 for each array element 108 chain share one of amplifiers 106). For example, amplifier 106 (labeled Amp 1) is a common amplifier for input data signals 102 (labeled $S_{1,1}(t)$ through $S_{M,1}(t)$) and, for the example illustrated in FIG. 1, M beams may share one common amplifier 106 for each array element 108.

In general, array antenna 100 may represent a conventional multibeam phased array architecture, such as for example a multibeam direct radiating phased array antenna employed for transmitting multiple beams. However, as described in further detail herein in accordance with an embodiment of the present invention, array element excitations (which may modify amplitude and/or phase values of input data signals 102) may be optimized to produce the desired antenna beams while reducing intermodulation (IM) interference from undesired IM antenna beams.

As described above, when one or more of amplifiers 106 are operated in a non-linear fashion, the non-linear amplifier characteristics result in mixing between the individual beam signals, which produces IM noise (interference). For the example of a direct radiating array (e.g., array antenna 100), the IM noise is radiated in distinct corresponding IM beams, with the IM beam shape and direction for each IM beam calculated, for example, from the order of the mixing product and the set of array element excitations for the desired antenna beams that cause the IM beam.

Figure 2:
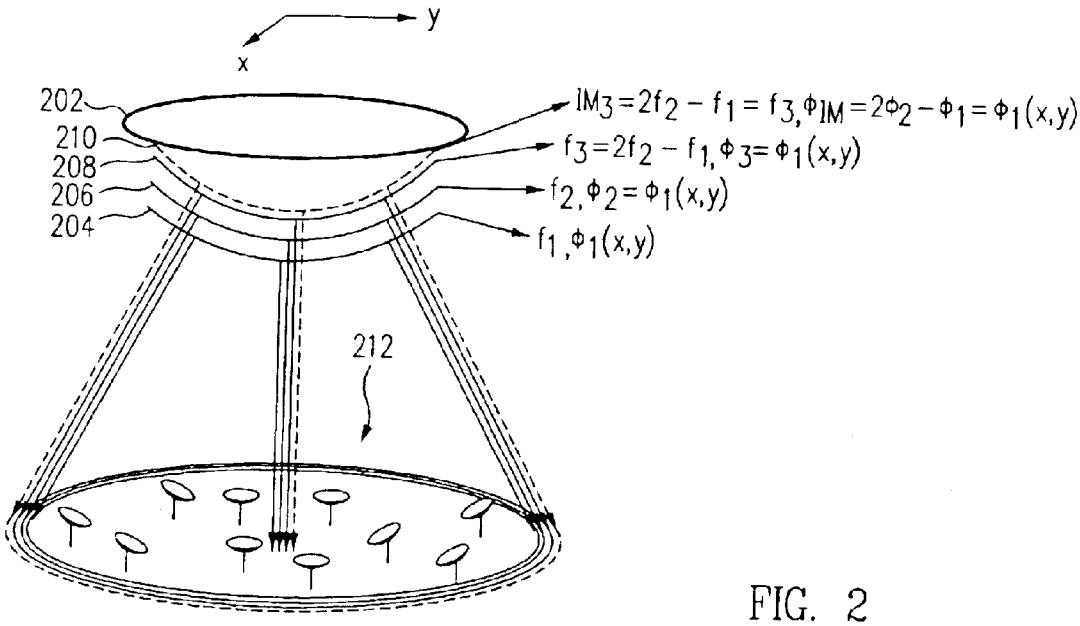
FIG. 2 shows an exemplary diagram illustrating multiple beams and an interfering intermodulation beam in accordance with an embodiment of the present invention.

For example, FIG. 2 shows an exemplary diagram illustrating multiple desired beams being radiated along with an interfering IM beam in accordance with an embodiment of the present invention. In this example, three beams are intended to be radiated from an array antenna 202 (e.g., similar to array antenna 100) to an antenna field 212, with the three beams represented by beams 204, 206, and 208. The frequency and phase of beams 204, 206, and 208 may be described in an exemplary fashion by the equations $f_1$, $\phi_1(x,y)$, $f_2, \phi_2=\phi_1(x,y)$, and $f_3=2f_2-f_1$, $\phi_3=\phi_1(x,y)$, respectively (e.g., three overlapping beams at three different frequencies).

The interfering IM beam may be represented by IM beam 210, which also radiates approximately to antenna field 212. The frequency and phase of IM beam 210 may be described in an exemplary fashion by the equation $IM_3=2f_2-f_1=f_3$, $\phi_{IM}=2\phi_2-\phi_1=\phi_1(x,y)$. Consequently for this example, the frequencies and positions (radiation direction) of beams 204 and 206 are such that IM beam 210 is produced at the frequency of beam 208 in the direction of one or more of the antennas in antenna field 212 that may be attempting to receive beam 208 (e.g., a third order mixing product associated with beams 204 and 206 results in interference for beam 208). Thus, IM beam 210 may contribute significantly to IM interference for beam 208.

In accordance with an embodiment of the present invention, an optimization approach may be employed to obtain a set of array element excitations for beams 204, 206, and/or 208 to reduce IM interference, which for example may be caused by beam mixing products. The IM interference reduction may be obtained by steering and/or defocusing IM beam 210 which is being radiated in the direction of a desired beam (i.e., beam 208 in this example) by utilizing amplitude and/or phase array element excitation control.

Figure 3:
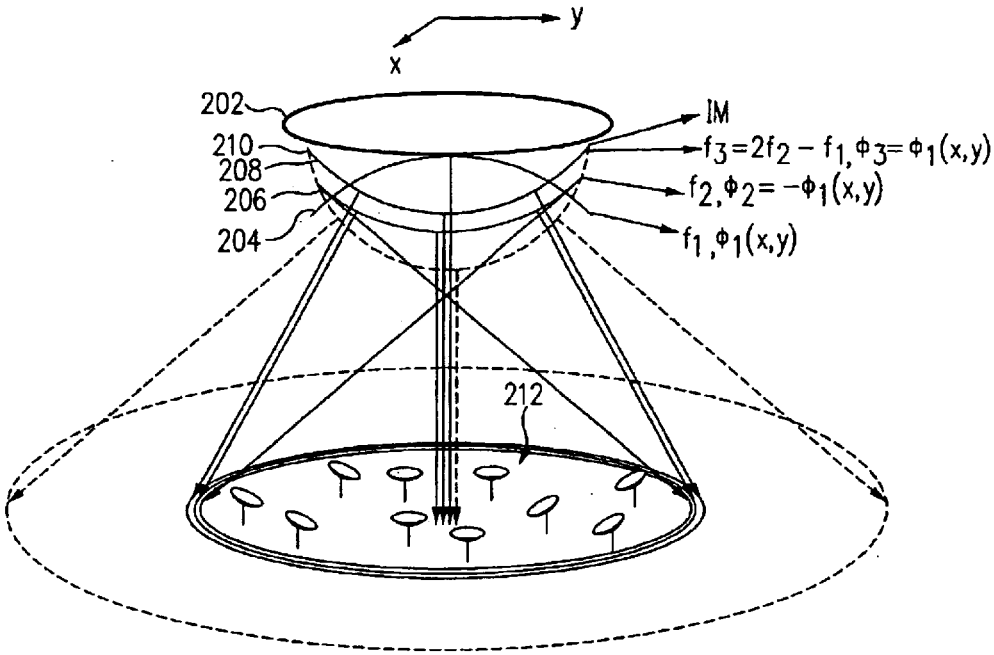
FIG. 3 shows an exemplary diagram illustrating multiple beams and an interfering intermodulation beam in accordance with an embodiment of the present invention.

For example, FIG. 3 shows an exemplary diagram illustrating beams 204, 206, and 208 along with IM beam 210 after application of the optimization approach in accordance with an embodiment of the present invention. In this example, the frequency and phase of beams 204, 206, and 208 may now be described in an exemplary fashion by the equations $f_1$, $\phi_1(x,y)$, $f_2$, $\phi_2=-\phi_1(x,y)$, and $f_3=2f_2-f_1$, $\phi_3=\phi_1(x,y)$, respectively.

As can be seen in FIG. 3, after optimization of the array element excitations for beams 204, 206, and 208, IM beam 210 has been defocused (and/or possibly steered) to reduce its radiated power relative to beam 208 in the direction of antenna field 212 and, therefore, reduce the amount of interference IM beam 210 poses to beam 208 or antennas attempting to receive beam 208 in antenna field 212. In other words for this example, the optimization approach provides a set of array element excitation coefficients (e.g., via control signals 110 discussed in reference to FIG. 1) that generally maintain the performance of beams 204, 206, and 208, while reducing a mainlobe power level of IM beam 210 directed towards antenna field 212 where one or more of the antennas (e.g., receiver terminals) are attempting to receive beam 208 having approximately the same frequency as IM beam 210.

For example, a third order mixing product associated with beams 204 and 206 may still result in interference for beam 208 (as in the example above in reference to FIG. 2), but in this example IM beam 210 has been defocused by using both converging and diverging phase solutions for beams 204 and 206, respectively. In general for this example, the shape of beams 204 and 206 may not change significantly. Alternatively, amplitude or amplitude and phase array element excitation control may be applied to reduce IM interference.

Referring to FIG. 1 to illustrate an example, assume three beam signals ($S_1(t)$, $S_2(t)$, and $S_3(t)$) are provided to amplifier 106 (Amp 1) to generate three beams through corresponding array element 108 (labeled 1). The non-linear characteristics of amplifier 106 result in IM products to be formed (e.g., due to the multicarrier input signal) such as illustrated in the equations below where $s_{in}(t)$ and $s_{out}(t)$ are the input and output signals, respectively, for amplifier 106.

$$s_{in}(t)=s_1(t)+s_2(t)+s_3(t) \tag{1}$$

where $$s_i(t)=A_i\cos(\omega_i t+\phi_i),\ i\in\{1, 2, 3\} \tag{2}$$

Each signal $s_i$ may have its own unique frequency $\omega_i$ and phase $\phi_i$. The nonlinear signal $s_{out}$ of the amplifier may be expressed as a third order polynomial expressed as in equation (3), as an illustrative example, although higher order terms exist. For this example, the second order products are assumed to fall outside of the frequency bands of interest while the third order IM products are assumed to dominate relative to other orders of IM products.

$$s_{out}(t)=\alpha_1 s_{in}(t)+\alpha_2 s_{in}(t)^2+\alpha_3 s_{in}(t)^3 \tag{3}$$

The third order term may be expressed as in equation (4).

$$s_{in}^3(t)=(A_1\cos(\omega_1 t+\phi_1)+A_2\cos(\omega_2 t+\phi_2)+A_3\cos(\omega_3 t+\phi_3))^3 \tag{4}$$

Expansion and trigonometric manipulation of equation (4) produces IM product terms, an exemplary sample of which is expressed in equations (5) and (6).

$$\frac{3}{4}A_i^2A_j\cos((2\omega_i-\omega_j)t+2\phi_i-\phi_j),\ i,\ j\in\{1, 2, 3\},\ i\neq j \tag{5}$$

$$\frac{3}{2}A_iA_jA_k\cos((\omega_i+\omega_j-\omega_k)t+\phi_i+\phi_j-\phi_k),\quad i,\ j,\ k\in\{1, 2, 3\},\ i\neq j\neq k \tag{6}$$

IM products of the form of equation (5) generally occur when two or more carriers are present in the input signal to amplifier 106. IM products of the form of equation (6) generally occur when three or more carriers are present in the input signal to amplifier 106. The two-carrier IM signal represented in equation (5) is radiated at a frequency $2\omega\phi_i-\omega_j$ and with a phase $2\phi_i-\phi_j$. Similarly, the three-carrier IM signal represented in equation (6) is radiated at a frequency $\omega_i+\omega_j-\omega_k$ and with a phase $\phi_i+\phi_j-\phi_k$. Although only one array element 108 has been considered so far, the same frequency and phase shifts are generally systematic over all of array elements 108, and therefore IM beams radiate from array antenna 100.

Figure 4:
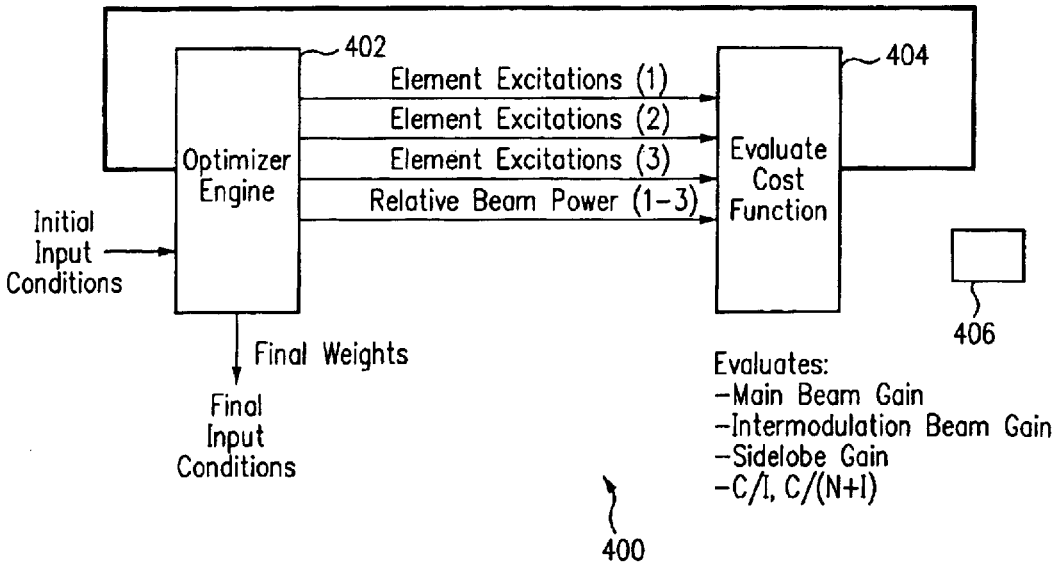
FIG. 4 shows a block diagram illustrating an intermodulation beam control system in accordance with an embodiment of the present invention.

In accordance with an embodiment of the present invention, the exemplary analysis and example described above may be applied to any number of beams and to any desired order or number of IM products. For example, FIG. 4 shows a block diagram illustrating a beam control system 400 in accordance with an embodiment of the present invention. System 400 includes an optimizer 402 (labeled optimizer engine) and an evaluator 404 (labeled evaluate cost function). Optimizer 402 and evaluator 404 may be combined into one component, represent separate components, or their functions may be implemented in software executed by a processor (possibly in conjunction with other hardware). The software may be stored in memory accessible by the processor (e.g., a computer system such as illustrated by a block 406), where the memory may be fixed (e.g., a hard drive) or removable (e.g., a floppy disk, a compact disk, or any other type of recordable medium, whether magnetic, optical, or other type).

Optimizer 402 receives (or may generate) initial input conditions, which may include initial array element excitations (also referred to herein as excitations) and input data signals (along with possibly the associated modulation scheme, relative amplitudes, and desired relative beam power). Optimizer 402 provides the initial input conditions to evaluator 404 to evaluate various parameters of interest, such as for example main beam gain or directivity, IM beam gain, sidelobe gain, amplifier operating point, copolarization signal relative to IM interference (C/I), and/or copolarization signal relative to noise (e.g., sidelobe interference) plus IM interference (C/(N+I)). Thus, evaluator 404 may be viewed as performing a cost function to calculate various parameters of interest and optionally comparing the calculation results to specified goals or requirements.

The results from evaluator 404 may be fed back to optimizer 402 which, depending upon the results or number of iterations (loops) scheduled to be performed by system 400, may modify the current array element excitations in an attempt to further optimize the array element excitations and the process repeated with evaluator 404 evaluating the revised array element excitations. For example, the process of system 400 may cycle (i.e., loop) through optimizer 402 and evaluator 404 a number of times to obtain the final input conditions (including array element excitations). Thus, optimizer 402 may provide the initial array element excitations or may provide optimized array element excitations (e.g., final weights or final values and labeled as final input conditions) to the multibeam phased array antenna, which for example may be utilized as control signals 110 of array antenna 100 (FIG. 1).

System 400 provides an optimization approach to evaluate or perform joint optimization for two or more beams along with the incorporation of IM lobe and/or sidelobe analysis into the cost function to yield improved system performance. In contrast, conventional approaches to multibeam phased array antennas in general provide array excitation element coefficients that satisfy requirements only for each beam independently (i.e., dependent only on the characteristics of each beam in isolation). For example, for a desired beam, an evaluation may be performed only with respect to mainlobe beam gain and possibly sidelobe beam gain and null gains for a single beam without consideration of other possible interfering sources.

System 400 with its multibeam optimization approach is applicable for any number of array element excitations. Thus, although system 400 is shown in an exemplary fashion operating on three beams and associated array element excitations, the procedure may be applied generally to any number of beams. Furthermore, system 400 may implement the multibeam optimization approach as a time domain analysis or as a frequency domain analysis, although depending upon the capabilities of system 400, the frequency domain analysis may generate results in a timelier fashion.

Optimizer 402, in accordance with an embodiment of the present invention, may be implemented, for example, as a conjugate gradient optimizer algorithm or as a sequential quadratic optimizer algorithm to optimize array element excitations based on the results of evaluator 404. As an example, the Matlab optimizer fminimax may be employed to implement a sequential quadratic optimizer algorithm to minimize the worst case cost parameters (i.e., optimize performance based on requirements or goals). The parameters may include, for example, optimizing the difference between the directivity goals and isolation goals and the actual (or calculated) directivity and isolation. Isolation may be defined, for example, as a ratio of the sum of the unwanted beam directivities at a given point of interest to the desired beam directivity at the same point.

The Matlab optimizer fminimax may be implemented to synthesize array element excitations that optimize performance or, stated another way, that minimize the worst case cost (e.g., based on results provided by evaluator 404). As another example, optimizer 402 may implement a conjugate gradient optimizer algorithm (e.g., implemented in a software language such as FORTRAN) to use gradient and curvature calculations to synthesize array element excitations that minimize the worst case cost (e.g., based on results provided by evaluator 404).

Alternatively, optimizer 402 may implement an optimization approach, for example, that explores the variable space as a quasi-random guess or may implement genetic algorithms for selecting array element excitations. Optimizer 402 may perform its optimization approach in closed form (e.g., as illustrated in FIG. 4) or by intuitive selections based on system experience or the mapping of past array element excitation selections and their associated performance.

Evaluator 404, as described above, may perform a cost function analysis. For example, evaluator 404 receives array element excitations (e.g., initial array element excitations or array element excitations resulting from one or more optimization iterations) along with possibly the input data signals for each desired beam (e.g., with associated modulation scheme and relative amplitudes) from optimizer 402. Evaluator 404 may then calculate and compare various parameters, such as for example beam performance (e.g., power levels, gain, effective isotropic radiated power (EIRP), sidelobe level, and/or directivity) for each intended beam, IM array element excitations, IM beam performance, amplifier gain compression or amplifier operating point, and/or isolation for each intended beam. Evaluator 404 may provide the results of the cost function, such as for example the differences between the requirements (e.g., goals) for the performance and the calculated performance (e.g., comparing EIRP and isolation of the intended beams to requirements).

Optimizer 402 may then attempt to minimize these differences by optimizing the array element excitations. For example, optimizer 402 may determine array element excitations that maximize the worst case EIRP and isolation for the desired coverage of each intended beam (e.g., subject to the constraint of maintaining the amplifier's nominal operating point). Isolation may be defined, for example, as the intended beam's EIRP minus the interfering beam's EIRP (which are at or near enough to the intended beam's frequency to cause interference). For example, the interfering beam's EIRP may include the summation of the EIRP from one or more of the IM beams and may also include other interferences, such as EIRP from sidelobe interference.

The coverage of each intended beam may be defined by one or more coverage points and these coverage points, for example, may correspond to points where the intended beam's directivity was initially set (e.g., as represented by the initial array element excitations to or generated by optimizer 402) or optimized. For example, array element excitations (or array element excitation coefficients) may be generated to maximize the pattern or gain level over the mainlobe beam region while minimizing the gain over sidelobe beam and null regions. The regions may be specified by discrete sets of coverage points where the gain performance is calculated.

For each coverage point for example, specified optimization goals or desired directivities are defined. For mainlobe beam points, an optimizer would try to obtain an excitation solution that exceeds the specified goal with positive margin (e.g., gain and isolation from IM beams are greater than their corresponding goals) while for null and sidelobe points the optimizer would try to obtain an excitation solution that exceeds the specified goal with negative margin (gain is less than the goal or maximum allowed). In this fashion, system 400 for example may optimize array element excitations to improve isolation while maintaining the desired EIRP of the intended beams (e.g., subject to the constraint that the associated amplifiers are driven or maintained at the desired nominal operating point).

Figure 5:
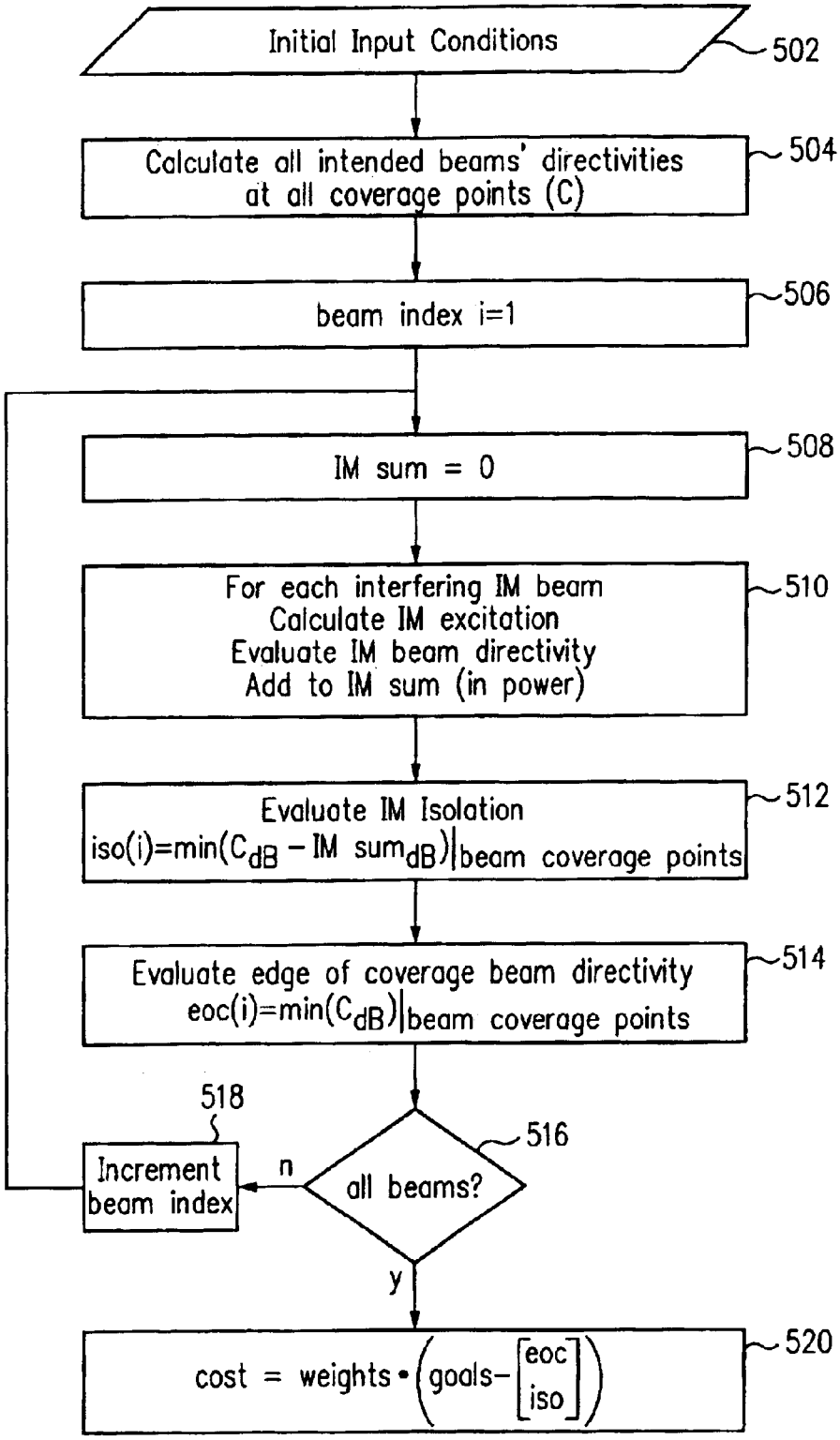
FIG. 5 shows a flowchart illustrating exemplary operations of the intermodulation beam control system of FIG. 4.

As an example of a cost function, FIG. 5 shows a flowchart 500 illustrating exemplary operations of evaluator 404 of FIG. 4. Evaluator 404 receives the initial input conditions (step 502 e.g., from optimizer 402), which may include array element excitations, input data signals (e.g., with associated modulation scheme and amplitudes or relative amplitudes), and calculates directivities (step 504) for the corresponding intended beams at desired coverage points (C). A beam index (a counter) is initialized (step 506) so that all of the intended beams are eventually evaluated by evaluator 404 and certain parameter values may also be initialized (step 508), such as the summation of the directivities of the IM beams (variable labeled IM sum).

The IM beams are determined and for each interfering IM beam the IM beam's excitation is calculated and its directivity determined and evaluated, with its power summed (in variable IM sum) along with the other IM beams (step 510, for example for IM beams at or near enough to the intended beam's frequency to cause interference). Other potential interferences may also be evaluated, such as for example interference from sidelobes, with their power included in the power summation (where IM sum may include other interferences besides IM interference).

It should also be understood that other parameters of interest may be included in flowchart 500 either in addition to or in substitution for a given parameter, depending for example upon the application and design requirements. For example, EIRP may be utilized as a parameter of interest in addition to or instead of the directivity parameter.

The isolation of the intended beam is calculated (step 512) across certain beam coverage points of interest (up to and including all of the coverage points) to determine the minimum isolation value between the intended beam's directivity and the potential interferers (e.g., IM beams). Other parameters of interest may also be determined. For example, the intended beam's directivity at its edge of main beam coverage may be evaluated (step 514), which may include values for example for the coverage points at or near the edge of coverage or all of the coverage points for thoroughness to verify the intended beam's directivity performance requirements are met.

This process is repeated so that all of the intended beams are evaluated (steps 516 and 518), as discussed above. The calculated parameters and the specified requirements (e.g., goals) may then be evaluated (step 520). For example, the edge of coverage (eoc) calculated may be compared to its goal and also the isolation (iso) may be compared to its goal to generate a cost function. These comparisons may also be weighted to assign a weighted priority to certain beams or to certain parameters of interest (e.g., isolation given priority over edge of coverage). Furthermore, a weighted constraint may be included in step 520 to ensure that the associated amplifiers are maintained at the desired nominal operating point (generally not required if only phase optimization is being performed, but may be implemented if amplitude or amplitude and phase optimization are being performed).

In accordance with one or more embodiments described herein, IM reduction techniques (e.g., IM beam control) are disclosed. For example, independent amplitude and phase distributions associated with each of the intended coverage beams are determined which satisfy the specifications on beam coverage performance, while also establishing and satisfying the specifications on a given interbeam isolation requirement (and possibly further including requirements for maintaining an amplifier's nominal operating point). The isolation may be for example with respect to IM beam interference due to several beams at different frequencies.

As an example, in accordance with an embodiment of the present invention, IM beams may be suppressed by phase optimization to improve isolation between an intended beam and its IM interference. For example, one or more of the techniques disclosed herein may provide improved efficiency and increased aperture reuse, with an effective increase in the efficiency of array element power amplifiers, for example, resulting in a possible 1 dB or more system improvement.

As discussed herein, in accordance with an embodiment of the present invention, an optimization approach is disclosed to increase the isolation between an intended beam and its interference (e.g., IM interference) by modifying the beam forming coefficients. Consequently, an operating point of the common amplifier for the beam forming coefficients may be maintained such that there is no change to the common amplifier's output power.

Embodiments described above illustrate but do not limit the invention. It should also be understood that numerous modifications and variations are possible in accordance with the principles of the present invention. Accordingly, the scope of the invention is defined only by the following claims.

We claim:

1. A method of determining array element excitations for input data signals of an array antenna, the method comprising:

evaluating initial array element excitations to determine intermodulation interference generated when the input data signals are transmitted as corresponding antenna beams;

determining expected performance of the antenna beams corresponding to the input data signals relative to the intermodulation interference; and modifying the initial array element excitations to generate modified array element excitations to improve the expected performance of the antenna beams relative to the intermodulation interference.

2. The method of claim 1, further comprising providing the modified array element excitations as array element excitations for the input data signals to be transmitted by the array antenna.

3. The method of claim 1, wherein the evaluating of the initial array element excitations comprises:

determining intermodulation beam signals;

determining intermodulation beam performance corresponding to the intermodulation beam signals; and calculating the intermodulation interference expected for each of the antenna beams corresponding to the input data signals.

4. The method of claim 1, wherein the determining expected performance of the antenna beams comprises calculating directivity, mainbeam gain, and/or EIRP at a number of coverage points.

5. The method of claim 4, wherein the determining further comprises calculating sidelobe beam gain, directivity, and/or EIRP at a number of coverage points.

6. The method of claim 4, wherein the determining operation further comprises a comparison of the expected performance for isolation, directivity, and/or EIRP to specifications.

7. The method of claim 1, wherein the modifying operation comprises modifying the initial array element excitations to perform phase optimization of the input data signals to suppress the intermodulation interference.

8. The method of claim 1, wherein the evaluating operation further comprises determining if any sidelobe interference is generated, the determining operation further comprises comparing the expected performance of the antenna beams relative to any sidelobe interference, and the modifying operation further comprises modifying the initial array element excitations to improve the expected performance of the antenna beams relative to any sidelobe interference.

9. The method of claim 1, wherein the modifying operation comprises a conjugate gradient optimizer algorithm, a sequential quadratic optimizer algorithm, or a genetic algorithm.

10. The method of claim 1, further comprising maintaining nominal operating points of amplifiers of the array antenna.

11. An antenna system comprising:

beam forming modules adapted to receive input signals and control signals;

amplifiers associated with the beam forming modules;

array elements coupled to corresponding ones of the amplifiers;

memory storing instructions; and a processor adapted to execute the instructions to calculate expected intermodulation interference and modify the control signals to reduce the intermodulation interference.

12. The antenna system of claim 11, wherein the beam forming modules provide amplitude and/or phase adjustments to the input signals based on the control signals.

13. The antenna system of claim 11, wherein the amplifiers are common amplifiers adapted to amplify more than one of the input signals.

14. The antenna system of claim 11, wherein the instructions further comprise the following operations to be performed by the processor:

calculating intermodulation array element excitations;

evaluating directivities and/or EIRP of intermodulation beams;

summing the intermodulation interference corresponding to each of the input signals; and calculating an isolation value of directivities and/or EIRP associated with the input signals relative to directivities and/or EIRP of the intermodulation beams.

15. The antenna system of claim 14, wherein the instructions further comprise the following operations to be performed by the processor:

comparing the isolation value to a desired value;

comparing the directivities and/or EIRP associated with the input signals to desired directivity and/or EIRP values; and modifying the control signals to optimize the isolation value and/or the directivities and/or the EIRP values associated with the input signals.

16. The antenna system of claim 15, wherein the instructions further comprise the following operations to be performed by the processor:

calculating sidelobe interference due to the input signals; and factoring the sidelobe interference into the isolation value calculated.

17. The antenna system of claim 11, wherein the antenna system is incorporated as part of a spacecraft.

18. A method of optimizing array element excitations for input signals to an array antenna, the method comprising:

calculating one or more antenna beam parameters corresponding to the input signals;

calculating one or more antenna beam parameters corresponding to intermodulation interference;

calculating a difference between the antenna beam parameters corresponding to the input signals relative to the antenna beam parameters corresponding to the intermodulation interference; and modifying the array element excitations to reduce the intermodulation interference.

19. The method of claim 18, wherein the calculating operation for the one or more antenna beam parameters corresponding to the input signals is performed for selected coverage points.

20. The method of claim 18, wherein the calculating operation for the one or more antenna beam parameters corresponding to the intermodulation interference further comprises calculating intermodulation array element excitations.

21. The method of claim 18, wherein the modifying operation substantially maintains directivities and/or EIRP corresponding to the input signals to desired values while reducing the intermodulation interference.

22. The method of claim 18, wherein one of the antenna beam parameters comprises edge of beam coverage for antenna beams corresponding to the input signals.

23. The method of claim 22, further comprising comparing the edge of beam coverage to desired first values and comparing the difference calculated to desired second values.

24. The method of claim 23, wherein the comparing operations for the edge of beam coverage and the difference are assigned weighted priorities relative to each other and to each of the associated input signals.

25. The method of claim 23, wherein the modifying operation further comprises maintaining amplifier levels at desired nominal operating points.

* * * * *